US005078667A

United States Patent [19]

Williams

[11] Patent Number: 5,078,667

[45] Date of Patent: Jan. 7, 1992

[54] THERMOPLASTIC HANDLED BAGS AND THEIR METHOD OF MANUFACTURE

[75] Inventor: John W. Williams, Oak Lawn, Ill.

[73] Assignee: First Brands Corporation, Danbury, Conn.

[21] Appl. No.: 698,037

[22] Filed: May 10, 1991

Related U.S. Application Data

[62] Division of Ser. No. 380,188, Jul. 14, 1989.

[51] Int. Cl.[5] ..... B31B 23/86; B31B 23/14

[52] U.S. Cl. ..... 493/195; 493/926

[58] Field of Search ..... 493/194, 195, 196, 197, 493/926

[56] References Cited

U.S. PATENT DOCUMENTS

| | | | |
|---|---|---|---|
| 4,165,832 | 8/1979 | Kuklies et al. | 229/54 R |
| 4,346,834 | 8/1982 | Mazumdar | 229/54 R |
| 4,401,427 | 8/1983 | Benoit et al. | 493/199 |
| 4,807,754 | 2/1989 | Rowe | 493/194 |
| 4,840,010 | 6/1989 | Pistner | 493/194 |

*Primary Examiner*—William E. Terrell
*Attorney, Agent, or Firm*—Gary L. Wamer

[57] ABSTRACT

The instant invention relates to a handled thermoplastic bag made of a thermoplastic film comprising a high density polyethylene or a major amount of high density polyethylene and a minor amount of one or more other polymers, e.g., linear low density polyethylene. The handled bag is characterized by a front and rear bag wall, a closed bottom and an open mouth top portion having a pair of laterally spaced handles, said front and rear bag walls, between said handles defining an open bag mouth and is further characterized as comprising a smoother cut-out edge at corner portions of the open bag mouth than provided at said lower mouth edge whereby the smoother cut-out edge of the corner portion reduces the tendency of the thermoplastic film to tear at the corner when subjected to stress.

13 Claims, 3 Drawing Sheets

THERMOPLASTIC HANDLED BAGS AND THEIR METHOD OF MANUFACTURE

This application is a division of prior U.S. application Ser. No. 380,188, filed July 14, 1989.

FIELD OF THE INVENTION

The instant invention relates to handled thermoplastic bags formed from a high density polyethylene or a mixture of a major amount of high density polyethylene and a minor amount of linear low density polyethylene. The structure of the bag mouth cut-out is especially designed to avoid tearing at the base of the bag handles which occurs as a result of stress concentration which tends to cause tearing and splitting of the bag film at the base of the handles when the bag is under load, i.e., during normal use of the bag.

DESCRIPTION OF THE PRIOR ART

The prior art relating to thermoplastic handled bags has undergone considerable historical development owing to the convenience in using thermoplastic handled bags, the relative ease of manufacturing thermoplastic handled bags and consumer acceptance of thermoplastic handled bags at numerous commercial establishments. The convenience of thermoplastic handled bags has been well received in the areas of trash bags and grocery store carry-out bags, as evidenced by their wide spread consumer acceptance.

Although the general appearance and utility of thermoplastic handled bags have resulted in considerable consumer acceptance, it is well known that thermoplastic handled bags are not without manufacturing and end use problems. These problems arise from the fact that the handles of the bag structure are conveniently manufactured as an integral part of the bag structure. For example, U.S. Pat. Nos. 4,085,822, 3,352,411 and 3,180,557 disclose thermoplastic handled bags having handle portions formed as an integral part of the bag structure, whereby the handles are an extension of the bag body on the opposing sides of the bag opening. Such handled bags are commonly manufactured from a flattened tube of thermoplastic film or a flattened tube of thermoplastic having side and/or bottom gussets formed therein. The thermoplastic handled bags are typically formed by transverse cutting and sealing a portion of the continuous flattened tube of thermoplastic film, whereby heat sealing occurs for the lower bottom edge of the current bag and the upper top edge of the next handled bag. Following or concurrent with the cutting and sealing step a U-shaped cut-out in the upper portion of the current bag is made to provide a U-shaped mouth, i.e., opening, for accessing the interior of the handled bag. The formation of the U-shaped cut-out forms handles adjacent the U-shaped bag mouth. These handles are used to carry the handled bag when articles or debris are placed into the handled bag. In some instances it will be desirable to provide side or bottom gussets in the handled bag or form the handled bag so as to have a square or other geometrically shaped bottom or provide some type of reinforcing layer of material in the handle or other portion of the bag, as heretofore recognized in the prior art.

The above general characterization of the prior art developments relating thermoplastic handled bags has not considered the several problems associated with forming such bags from specific thin thermoplastic films. Since the thermoplastic film used in manufacturing such handled bags are typically between about 0.5 to 3.0 mils in thickness there is considerable concern over any tendency of the film to split or tear under stress, i.e., when a thermoplastic handled bag is lifted by the handles after having contents, i.e., a load, placed therein.

A particularly serious problem arises owing to the manufacturing processes by which thermoplastic handled bags are formed. The U-shaped mouth of the thermoplastic handled bag is formed by employing a punch-out device. This punch-out device creates small substantially uniform V-shaped nicks at the edge of the U-shaped cut-out along the edge of the U-shaped mouth of the handled bag. The formation of such V-shaped nicks are particularly critical and disadvantageous in view of the tendency of thermoplastic handled bags to tear at stress points associated at or near such V-shaped nicks. Further, owing to the very design of thermoplastic handled bags there is a tendency for the stress forces created by lifting a loaded handled bag to become localized or concentrate near the base portion of the bag handles. This localized weight and lift-induced stress at the base portion of the bag handles is a particularly acute problem when these lower handle base portions are also characterized as having V-shaped nicks or small edge tears as a result of making the U-shaped cut-outs. This problem has heretofore been addressed in several ways. For example, U.S. Pat. Nos. 4,326,664 and 4,401,427 disclose reinforcing members at various portions of the mouth of the bag. These reinforcing members are provided to provide additional strength at the portion of the bag undergoing stress during use of the handled bag but also increase the amount of material required to manufacture each bag.

Another approach at minimizing the effect of stress concentration at the base portion of the bag handles is disclosed in U.S. Pat. No. 4,165,832. U.S. Pat. No. 4,165,832 discloses a handled bag structure formed from a thermoplastic film having handles with increased width at their top portion (as compared to the width of the base of the handles) and having "stress relief notches" positioned at the base of the handles. The stress relief notches and their functionality are discussed by the patentee at column 4, lines 47 to 60, whereat the patentee states that the combination of the increased handle width, a stress relief notch (shown in U.S. Pat. No. 4,165,832 as stress relief notch 12 in FIGS. 7 and 7-A) and the fact that there are no nicks or slight tears in the area S' (shown in FIGS. 7 and 7-A) in the stress relief notch area results in a reduced tendency of the patentee's bag structure to tear during normal loading and carrying operations. Although the patentee does not also discuss the handle design, the patentee's claims and arguments in support of nonobviousness also require that the width at the top portion of the handle be wider than the lower base portion of the handle. The importance of this handle design (also shown in FIGS. 7 and 7-A) and its relationship to change the lines of force are shown in FIGS. 7 and 7-A.

It is clear from the patentee's disclosure in U.S. Pat. No. 4,165,832 that the patentee has not considered the complexity of the physical and chemical properties of the thermoplastic film composition and the relationship of such properties to the tendency of a stressed area of the handled bag to split or tear. The patentee references the thermoplastic material only as low density polyethylene at column 4, lines 22–23. The patentee clearly does not disclose any appreciation of the importance of the selection of the film composition to the use characteristics of the thermoplastic handled bag.

The failure of the prior art to appreciate the complexity of the correlation between the vast array of thermoplastic film compositions and the physical end use characteristics of a handled bag has resulted in numerous complex design changes in the mouth of the bag, all of which have failed to consider the nature of the thermoplastic film composition. According to the instant invention, it has found that it is advantageous in manufacturing a thermoplastic handled bag comprising a high density polyethylene (including films containing a major amount, e.g., between 65 to 90 weight percent high density polyethylene resin [having a density of about 0.940 or greater] and a minor amount of a linear low density resin [having a density of about 0.930 or less]) that the mouth portion of the handled bag should be characterized as having a smoother cut-out portion at the lower portion, i.e., base of the handle than needed in the mouth portion between the handles or along the inner mouth edges of the handles. The use of such a U-shaped cut-out having smoother cut-out corner portions for the aforementioned film composition is particularly advantageous in the commercial manufacturing of thermoplastic handled bags, since handled bags having satisfactory end use properties can be produced without stress relief notches. Further, it has been found to be beneficial to commercial production rates to have as great an area having a perforated edge with some level of V-shaped nicks or tears as is possible.

SUMMARY OF THE INVENTION

The instant invention relates to a thermoplastic handled bag made of a thermoplastic film comprising a high density polyethylene (including a film comprising a major amount of high density polyethylene and a minor amount of linear low density polyethylene), as hereinafter discussed. The handled bag is characterized by a front and rear bag wall, a closed bottom and an open mouth top portion having a pair of laterally spaced handles, said front and rear bag walls, between said handles defining an open bag mouth, an upper mouth edge formed from each handle extending above the mouth edge from a lower handle portion defining the lateral extent of said bag mouth to an upper handle portion defining a hand grip, a lower mouth edge extending intermediate the lower handle portions and meeting therewith at corner portions of said open top mouth portion. The handled bag of the instant invention is further characterized as comprising a smoother cut-out edge at said corner portions adjacent the lower handle portions than provided at said lower mouth edge whereby the smoother cut-out edge of the corner portion, i.e., area of the bag mouth at the base of the handles, reduces the tendency of the aforementioned thermoplastic film to tear at the corner portion when subjected to stress.

The instant invention also comprises a method for manufacturing a handled bag made of the aforementioned high density polyethylene film. The method comprises manufacturing a handled bag having a front and rear bag wall, a closed bottom and an open mouth top portion having a pair of laterally spaced handles, said front and rear bag walls between said handles defining an open bag mouth, an upper mouth edge formed from each handle extending above the mouth edge from a lower handle portion defining the lateral extent of said bag mouth to an upper handle portion defining a hand grip, a lower mouth edge extending intermediate the lower handle portions and meeting therewith at corner portions of said open top mouth portion, wherein the open top portion is formed by use of a punch-out knife by providing a punch-out knife having a smoother cut-out edge in the area on the knife edge whereat the corner portions will be formed. The use of such a punch-out knife results in a smoother cut-out edge being formed at the corner portions than is provided at the remainder of the mouth edge whereby the smoother cut-out edge of the corner portion reduces the tendency of the thermoplastic bag film to tear at the corner portion when the bag is subjected to stress during use while not significantly adversely affecting commercial bag manufacturing rates.

DETAILED DESCRIPTION OF THE INVENTION

Figure 1:
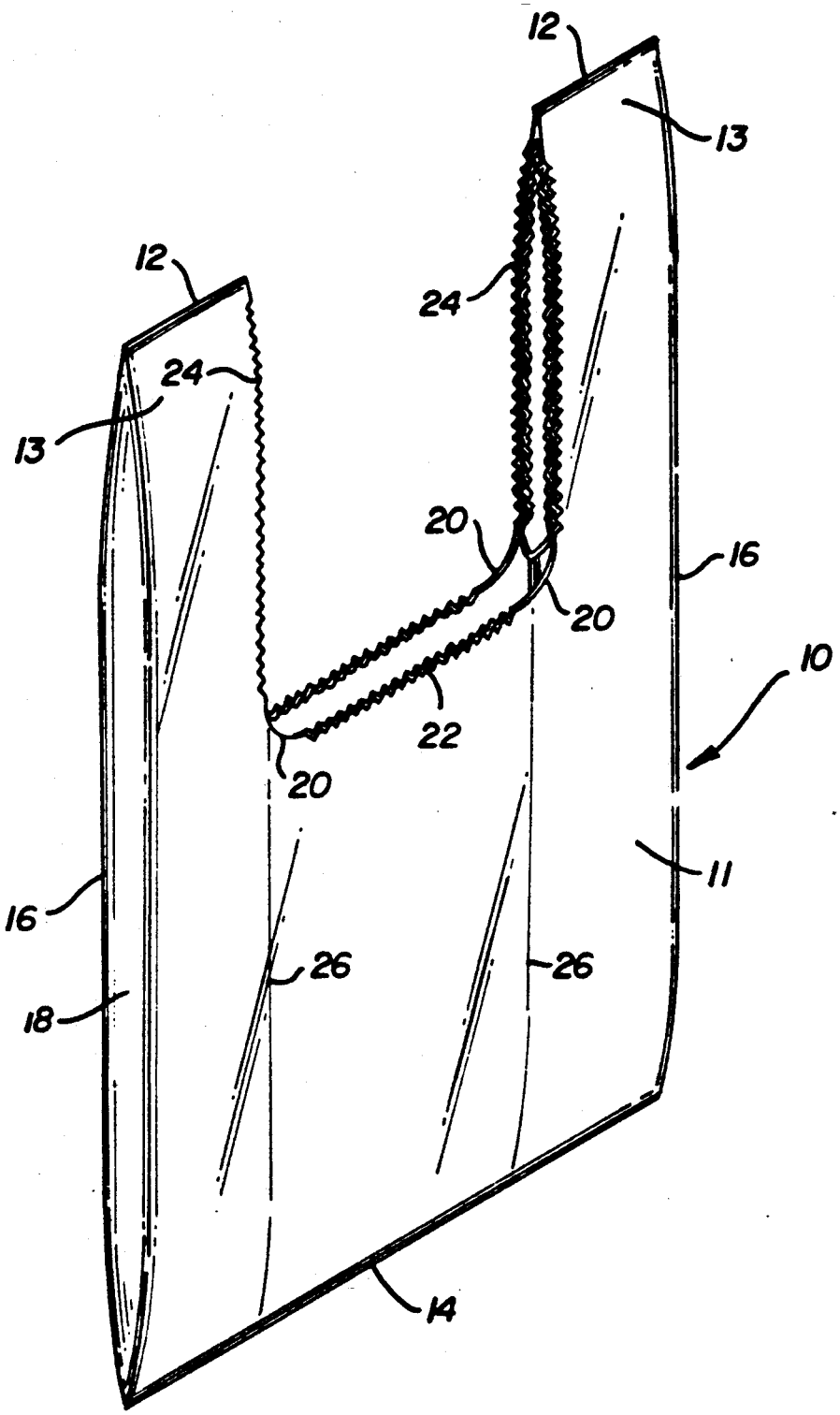
FIG. 1 is a perspective view of the thermoplastic handled bag of the instant invention.

The instant invention relates to a handled bag made of a thermoplastic film comprising a high density polyethylene, including a high density polyethylene film comprising a major amount of high density polyethylene and a minor amount of linear low density polyethylene. The handled bag of the instant invention is characterized as having a front and rear bag wall, a closed bottom and an open mouth top portion having a pair of laterally spaced handles, said front and rear bag walls between said handles defining an open bag mouth, an upper mouth edge formed from each handle extending above the mouth edge from a lower handle portion defining the lateral extent of said bag mouth to an upper handle portion defining a hand grip, a lower mouth edge extending intermediate the lower handle portions and meeting therewith at corner portions of said open top mouth portion and is further characterized as having a smoother cut-out edge at the corner portions than provided at said lower mouth edge whereby the smoother cut-out edge of the corner portion reduces the tendency of the thermoplastic film to tear at the corner portion when subjected to stress.

The instant invention also relates to a method of manufacturing the aforementioned thermoplastic bag. The method generally comprises forming a flattened tube (alternatively, a U-shaped film may be employed with additional heat sealing steps for forming a side seal[s]), folded over a piece of thermoplastic film having sealed sides, sealed top and bottom, and forming a U-shaped mouth with opposing handles on either side using a punch-out device having two distinct cutting surfaces where one cutting surface is smoother than the other whereby the corner portion of the U-shaped mouth at the lower handle portion is formed with the smoother knife portion whereby a smoother cut-out edge is formed at said corner portions at the lower handle portion whereby the presence of the smoother cut-out portion reduces the tendency of said thermoplastic film to tear at the lower handle portion when subjected to stress.

In a further embodiment the invention relates to a method for manufacturing a handled bag made of a thermoplastic film, said bag comprising a front and rear bag wall, a closed bottom and an open mouth top portion having a pair of laterally spaced handles, said said front and rear bag walls, between said handles defining an open bag mouth, an upper mouth edge formed form each handle extending above the mouth edge from a lower handle portion defining the lateral extent of said bag mouth to an upper handle portion defining a hand grip, a lower mouth edge extending intermediate the lower handle portions and meeting therewith at corner portions of said open top mouth portion, wherein said handled bag is made by:

(1) forming a flattened tube of thermoplastic film and, optionally, forming gussets in said flattened tube;

(2) providing said flattened tube of thermoplastic film to a bag manufacturing station;

(3) clamping a portion of the flattened tube with a clamp having an opening for mating with a U-shaped punch-out knife, said portion to be the top portion of the handled bag;

(4) sealing transverse the flattened tube below the top portion to form a bottom portion of said handled bag and providing a seal across the top of said top portion of the next handled bag; and (5) forming the open mouth top portion by use of said U-shaped punch-out knife characterized by smooth knife portions whereat the corner portions of the open mouth top portion will be formed whereby a smoother cut-out edge will be formed at said corner portions than provided at said lower mouth edge whereby the smoother cut-out edge of the corner portion reduces the tendency of the thermoplastic film to tear at the corner portion when subjected to stress.

The thermoplastic handled bag of the instant invention is characterized by the smoother cut-out corners at the base of the handles, the substantially less smooth surfaces of the other surfaces of the cut-out mouth portion. Further, the instant handled bag is formed from a thermoplastic film material comprising a high density polyethylene which includes use of only high density polyethylene and, e.g., a thermoplastic film material comprising a major amount of a high density polyethylene and a minor amount of a linear low density polyethylene. The high density polyethylene is characterized as having a density greater than about 0.940, preferably between about 0.945 and about 0.955 and a high load melt index between about 1.0 and about 15, preferably between about 5 and about 15.0. The high load melt index for the high density material is the high load melt index (temperature=190 C.; Piston weight=21.60 Kg) as determined by ASTM Test Method D-1238 (Condition F). When the thermoplastic film material contains a minor amount of a linear low density polyethylene the linear low density polyethylene is characterized as having a density below about 0.930, preferably between about 0.910 and about 0.920, and has a melt index between about 0.2 and about 5.0, preferably between about 0.8 and about 1.2 (ASTM Test Method D-1238 [Condition E]).

The terms "major" and "minor" are also employed herein to mean that the weight percent of high density polyethylene will be greater than the amount of all other polymer components, e.g., linear low density polyethylene or other polymer components, in the thermoplastic film composition. The term "high density polyethylene" is employed herein to include only high density polyethylene and to include polymer blends having high density polyethylene as the polymeric component wherein high density polyethylene is present as the major component of the polymer blend (e.g., blended with one or more polymers, including, but not limited to linear low density polyethylene, polypropylene, polybutylene and the like or as the major component of a layer of a laminated film structure).

In one embodiment the thermoplastic film comprises: between about 65 weight percent and about 90 weight percent of a high density polyethylene having a density between about 0.945 and about 0.955 and having a high load melt index between about 5.0 and about 15.0; and between about 5 percent to about 30 weight percent of a linear low density polyethylene having a density between about 0.910 and about 0.920 and a melt index between about 0.8 and about 1.2. In addition to the high density polyethylene component and, optionally, the linear low density polyethylene or other polymer components (present in a minor amount), the thermoplastic film composition employed herein will typically and may optionally contain a masterbatch additive comprising processing aids and/or colorants, e.g., carbon black, $TiO_2$, dyes, slip agent, antioxidants, photodegradants, biodegradable additives (e.g., starch) and the like. It is generally known that thermoplastic films containing a major amount of high density polyethylene will require use of little, if any, slip agent in the film extrusion or blown film processing. The masterbatch component will typically comprise between about 1 and about 10 weight percent of the total film weight. The masterbatch typically contains a carrier polymer as a masterbatch component. The aforementioned amount of high density polyethylene includes any carrier polymer which may be present as a component of the masterbatch.

The high density polyethylene, having a density of at least 0.940, included in the compositions of the invention, may be prepared by one of the methods known in the prior art. High density polyethylene is typically prepared either by homopolymerizing ethylene or by copolymerizing at least 95% by weight of ethylene with up to 5% by weight of one or more upper alpha-olefins containing 3 to 8 carbon atoms, such as propylene or 1-butene or 1-hexene. Several commercially available products suitable for use in the manufacture of the instant handled bags include NATENE TM 60020 AG and NATENE TM 4 54000; a high density polyethylene sold under the product designation ALATHON TM L5005 (available from Cain Chemical Company, having a high load melt index of about 8.5 and a density of about 0.950); and a high density polyethylene sold under the product designation HOSTALEN® GM9255HP (available from Hoechst Celanese, having a high load melt index of about 7.5 and a density of about 0.950).

Linear low density polyethylene may be prepared by one of the known polymerizing methods known in the prior art and has a density of about 0.930 or less. The linear low density polyethylene compositions are typically obtained by copolymerizing 85 to 95% by weight of ethylene with 5 to 15% by weight of one or more upper alpha-olefins containing 3 to 8 carbon atoms, typically selected chiefly from propylene, 1-n-butene, 1-n-hexene, 4 methyl-1-pentene or 1-n-octene. Several commercially available linear low density polyethylenes include: NATENE TM BDC404 (melt index of about 0.55 and a density of about 0.913); UCC 7028 (available from Union Carbide Corporation, having a melt index of about 1.0, density of about 0.918 and formed by copolymerizing ethylene and 1-hexene); and UCC 7047 (having a melt index of about 1.0 a density of about 0.918 and made by copolymerization of ethylene and 1-butene).

U.S. Pat. Nos. 3,998, 914 and 4,786,688, incorporated herein in their entirety by reference thereto, generally disclose polymer blends of high density polyethylene and linear low density polyethylene which applicant believes are suitable for use in the manufacture of the handled bags of the instant invention, although a thermoplastic film containing only high density polyethylene as the polymer may be employed herein (optionally containing processing and colorant additives).

In one embodiment the thermoplastic handled bag of the instant invention is formed of a polymer composition comprising: (1) about 72 percent by weight of a high density polyethylene having a high load melt index of about 8.5, a density of about 0.950 and having a broad, bimodal molecular weight distribution which is sold under the trade designation ALATHON TM L5005; (2) about 20 percent by weight of a 1-hexene based linear low density polyethylene having a melt index of about 1.0, a density of about 0.918 and sold under the trade designation UCC 7028; and, (3) about 8 percent of a masterbatch comprising about 40–50 weight percent of a linear low density polyethylene as a carrier polymer, about 40–50 weight percent of a colorant (such as $TiO_2$ or carbon black) with small amounts of additional other optional processing aids such as antioxidants, a photodegradant, slip agent (optional) and the like.

Figure 3:
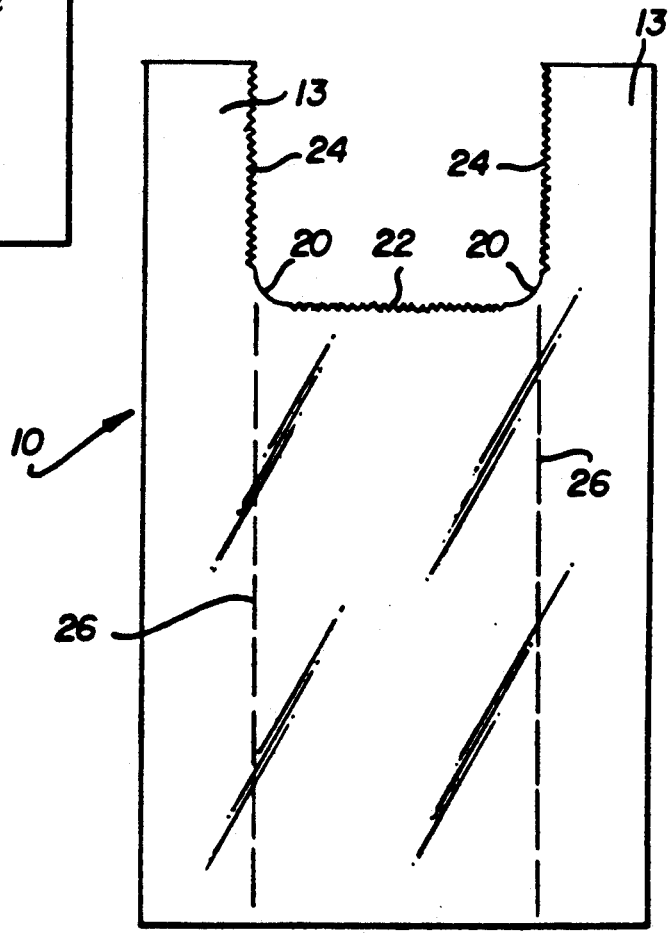
FIG. 3 is a front elevational view of one form of the thermoplastic handled bag of the instant invention.
Figure 5:
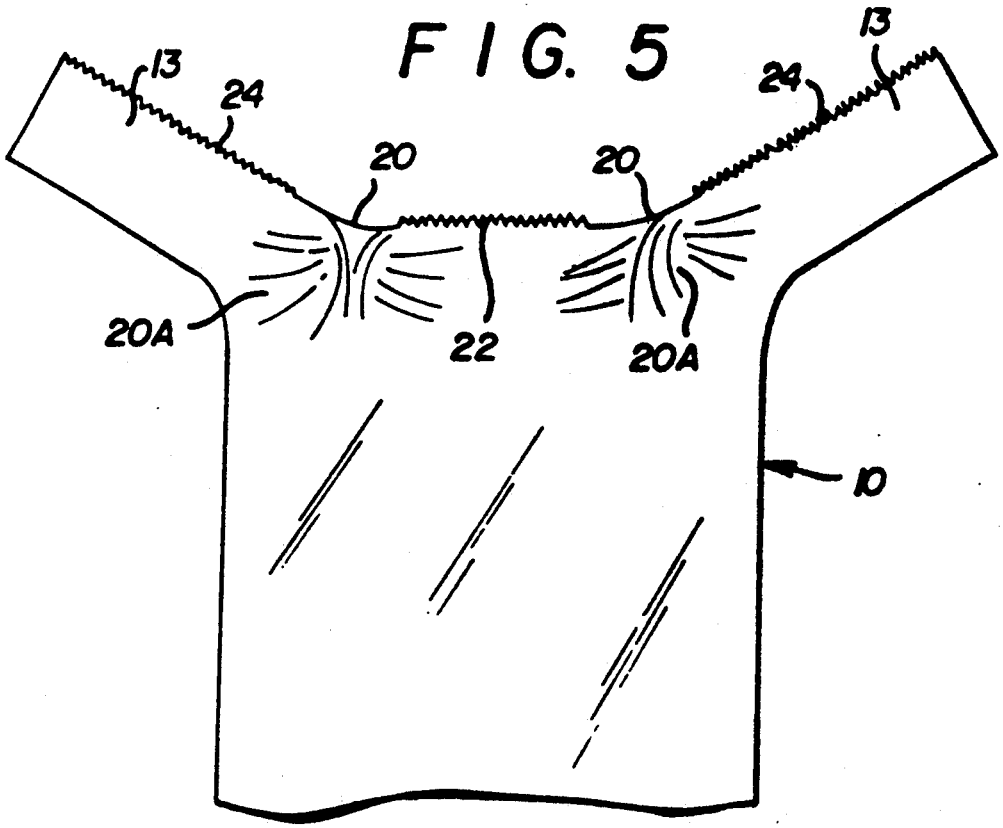
FIG. 5 is a schematic representation of a thermoplastic handled bag of the instant invention.

The handled bag of the instant invention, shown in FIGS. 1, 3 and 5, generally comprises a handled bag fabricated from a flattened gusseted thermoplastic tube. The actual dimensions of the handled bags are a matter of choice and are generally determined by the anticipated use of the handled bag. Referring to FIG. 1, handled bag 10 comprises attached upper bag handle members 13 with top sealed edges 12. The handled bag 10 has side wall 11, sealed bottom portion 14, side edges 16 with inwardly folded gussets 18. The incorporation of a gusset is not required in all handled bags according to the instant invention, but is beneficial when a thin film (e.g., less than 1.0 mil) is employed in manufacturing the handled bag since the inwardly folded gusset provides both a double ply of film for forming each handle portion 13 whereby improved strength and handleability are achieved and provides an overall smaller bag footprint for improved handling during manufacture. Referring to FIG. 1, handle portions 13 have been formed by cutting out a U-shaped portion whereby a bag mouth opening is formed in the top portion of handled bag 10. The edge of the U-shaped cut-out, according to the instant invention, is characterized by smoother cut-out corner portions at the lower portion of the handle portion 13 than provided at the remaining portions of the edge of the bag mouth. Smoother corner portion 20 is characterized as having substantially no tears or aberrations whereat tears in the thermoplastic film may originate. Mouth edge portions 22 and 24 are characterized as having a greater number of nicks, tears or edge aberrations per unit length than the smoother corner portions 20. The relative smoothness of corner portions 20 as compared to mouth edge portions 22 and 24 is also important in manufacturing a handled bag from the instant thermoplastic film compositions for both bag performance reasons and manufacturing reasons, as hereinafter discussed.

Figure 2:
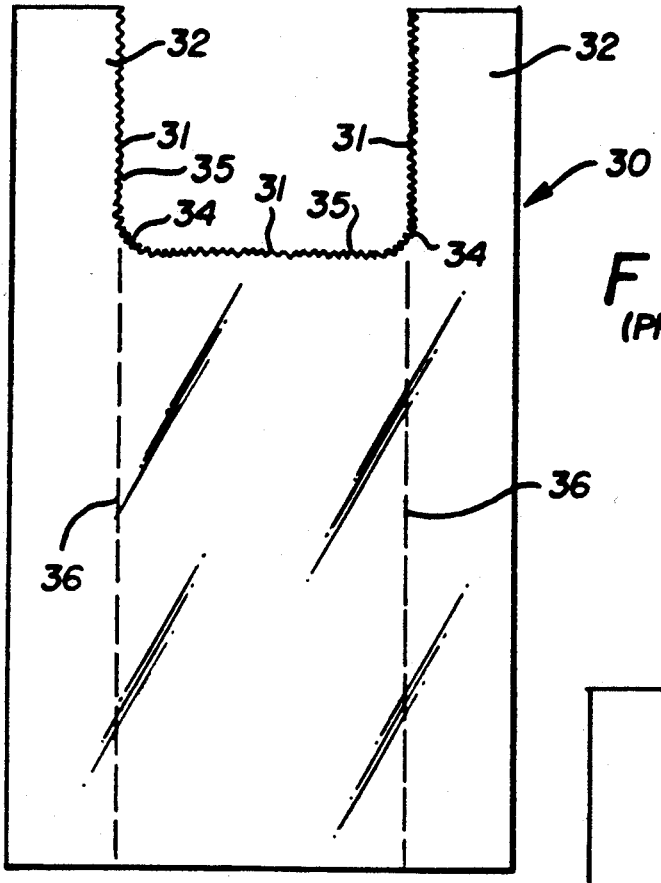
FIG. 2 (PRIOR ART)
FIG. 2 is a schematic representation of a prior art thermoplastic handled bag.

Referring to FIG. 2 and FIG. 3, FIG. 2 shows a prior art handled bag having handle portions 32, corner portions 34 and mouth edge portions 31. As shown in FIG. 2 the entire length of the bag mouth is characterized by small nicks or tears 35 characteristic of heretofore employed punch-out methods using a punch-out knife having a serrated cutting edge. The presence of nicks or tears 35 in the area of stress lines 36 of the handled bag tend to act as sites at which a tear in the film will originate. These nicks or tears 35 were not a significant problem when the handled bag was formed from a low density polyethylene film owing to the tendency of such films to stretch at a nick or tear at an edge rather than tear and is a thermoplastic film characterized as having a much higher tear resistance force. Unfortunately, when employing a thermoplastic film formed from a high density polyethylene, as hereinbefore described, the presence of nicks or tears at the corner portions becomes a more significant concern owing to the "splitty" characteristic of high density polyethylene films containing a major amount of a high density polyethylene. Referring to FIG. 3, it has been found that by forming corner portions 20 with a smoother cut-out edge than at mouth edge portions 22 and 24 that the tendency of handled bag 10 to tear or split along the lines of stress 26 during use is substantially reduced. This is a surprising result when the prior art, e.g., U.S. Pat. No. 4,165,832, is considered, since the prior art generally teaches that the presence of reinforcement materials or stress relief notches are required to minimize tearing at the corner portions.

Figure 4:
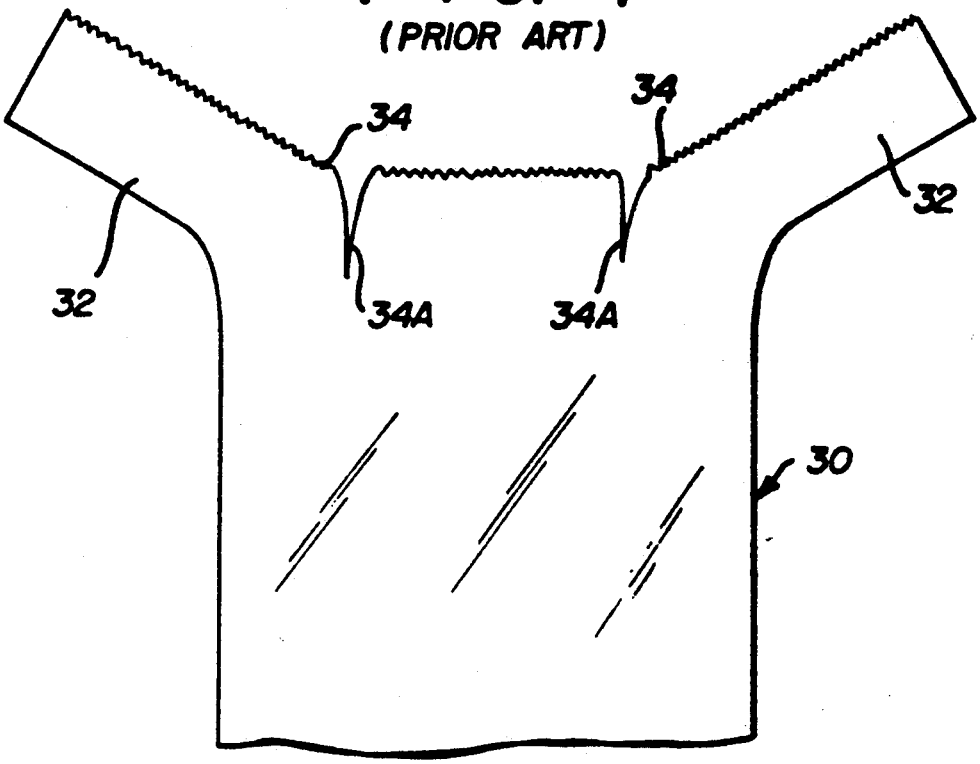
FIG. 4 (PRIOR ART)
FIG. 4 is a schematic representation of a prior art thermoplastic handled bag.

The aforementioned reduced tendency of the handled bags of the instant invention to undergo splitting at the corner portions is better understood by reference to FIG. 4 and FIG. 5. FIG. 4 shows a handled bag according to the prior art having body 30, handle portions 32 and corner portions 34 with nicks in the area of corner portions 34. As the handled bag is used, stress is applied during use at corner portions 34 and the film has a tendency to split at a nick (shown in exagerated size in all Figures as V-shaped nicks) or tear at corner portion 34 to form stress tears 34-A. This is to be contrasted with the instant invention, as shown in FIG. 5, where a handled bag having bag body 10 with handle portions 13 is shown under use conditions as above discussed for FIG. 4. Since the handled bag has been formed with smoother corner portions 20 as compared to mouth edge portions 24 and 22 there are substantially no nicks or tears at corner portions 20, and when the handled bag is placed under stress and the film tends to stretch at 20-A rather than tear or split as shown in FIG. 4.

The handled bag of the instant invention is also advantageous in a commercial manufacturing process. The handled bag of the invention is typically formed one at a time on an intermittent or continuous process. In a typical commercial manufacturing process a flattened tube of film is provided with side gussets and then passes through nip rolls for further processing. The gusseted film then moves to a bag manufacturing location, stops and the film is clamped at the area which will be the top portion of the handled bag. A punch-out device, i.e., knife, passes through the clamped film to form the U-shaped bag mouth while a hot knife sealer or other sealer forms the bottom seal of the bag and seals the top of the next bag, i.e., the bag end whereat the U-shaped bag mouth will be formed in the next bag.

Although use of a punch-out knife having only a smooth surface is known in the art for low density polyethylene bags, such a punch-out knife is disadvantageous in that the difficulty in cutting the film to form the U-shaped cut-out at a high number of repetitions per minute, e.g., at least 45 and preferably at least 60 per minute, increases with the smoothness of the blade of the punch-out device. For example, one reason for the prior art use of serrated punch-out blades is the improved commercial manufacturing rates achieved by use of such serrated punch-out blades.

The following examples are provided as exemplary of the invention and are not intended to be limiting thereof:

EXAMPLE 1

A thermoplastic blown film having a thickness of about 0.7 mils was formed from a polymer composition comprising:

(1) 72 weight percent high density polyethylene sold under the trade designation Cain L5005 and having a melt index of about 0.055 and a density of about 0.950;

(2) 20 weight percent linear low density polyethylene sold under the trade designation UCC 7028 and having a melt index of about 1.0 and a density of about 0.918 (UCC 7028 is a hexene based polymer); and (3) 8 weight percent of a material batch sold under the trade designation Ampacet 11560, having a melt index of about 13.0 and containing 50 weight percent $TiO_2$ (as a white colorant) and a 50:50 carrier polymer blend of high pressure low density polyethylene and linear low density polyethylene.

Handled bags were to be manufactured by the same commercial manufacturing process using the following three punch-out knives: (1) a serrated punch-out blade having a toothed surface with fourteen (14) teeth per inch with each tooth being 0.062 inch in height with sharp cutting surfaces there between; (2) a smooth punch-out knife having no teeth, i.e., only a U-shaped smooth knife edge; and (3) a U-shaped punch-out knife having smooth corners in the regions where the punch-out knife will form the corner portions 20 (see FIG. 1) of the bag mouth near the lower handle portions while the remainder of the punch-out knife is as above-described for the serrated punch-out knife with fourteen (14) teeth per inch with each tooth being 0.062 inches tall with sharper surfaces there between. Handled bags manufactured with the smooth punch-out knife were not evaluated further. Owing to the failure of the smooth punch-out knife to consistently punch out the U-shaped bag portion which is removed to form the open mouth portion of the bag, such a smooth punch-out device is not useful for commercial manufacturing processes.

Each of the three above-described punch-out knives were evaluated using the same flattened tubular film using the same commercial manufacturing process at the same bag manufacturing rates for the manufacture of handled bags and were manufactured by making the U-shaped cut-out one at a time. The smooth punch-out knife was ineffective in forming a U-shaped cut-out since the completely smooth surface of the punch-out knife would not completely punch out the U-shaped portion of film in a consistent manner to form the open mouth of the bag. These frequently incomplete cut-outs cannot be tolerated in a commercial manufacturing operation, since such result in greatly reduced machine efficiency and, hence, greatly increases the cost of manufacturing each bag. Both the serrated and smooth corner/serrated punch-out knives were effective in consistently manufacturing the U-shaped bag punch-out at a rate of at least 60 bags per minute. Handled bags formed with the latter two mentioned punch-out knives were then end use tested.

A side by side end use comparison was made of handled bags formed by a serrated punch-out knife (Bag A) and handled bags formed by a smooth corner/serrated punch-out knife (Bag B) in accordance with the instant invention. The only difference between Bag A and Bag B was the smooth corner portions of the bag mouth at the base portion of the handles (identified as corner portions 20 in FIG. 1) of Bag B. Overall the handled bag is as shown in FIG. 1 and (except as to the corner portions, as aforementioned,) and was formed a 0.7 mil blown film, was formed from a 25 inch wide tubular film having 4.5 inch gussets (2.25 inches deep) at each side, was 28 inches long having handle portions about 3.0 ($\pm$0.5) inch wide and about 7 inches long. The end use testing was conducted by having seven (7) judges randomly use use six (6) bags, randomly selected as Bag A or Bag B; by picking up by removal from a container, carrying and dropping the bags (from eighteen (18) inches) two times with the six (6) bag samples being furnished to the judges in random order. The test was conducted by placing a seventeen (17) pound load of a standard trash mixture in Bag A or Bag B after the bag was placed in a container. Each judge was asked to lift the bag from the container, carry it a fixed distance, drop the bag on a concrete floor from a distance of eighteen inches, lift the bag and carry it a fixed distance and again drip the bag onto a concrete floor from a distance of eighteen inches. The judges were instructed to conduct all lifting and carrying using the handles of the handled bags. Each judge was asked to test a total of six (6) bags according to the above test method. In this fashion, 21 samples of Bag A and 21 samples of Bag B were tested. At the end of each test the bag was evaluated to determine if a handle failure had occurred. As a result of the test, it was observed by a single independent judge (8th judge) that the handled bags having the smooth corner portions (Bag B) showed a significant improvement in providing a decrease in the total number of bag failures arising from handle failures. A handle failure is judged as a failure if the film at the corner portion tears transverse the lower handle portion to the side of the bag such that the handle portion of at least one wall is torn from the front or rear panel of the bag. As a result of the above tests, a handle failure occurred for 6 of the 21 Bag A samples whereas only 1 of the 21 Bag B samples gave a handle failure.

The results of this random panel test demonstrates that the inclusion of smooth corner portions at the lower handle portions improves the performance of the handled bag by significantly reducing the tendency of the high density polyethylene film to tear and/or split at the corner portions. Referring to FIG. 5, end use of a handled bag typically involves sideway stress. The introduction of the smooth corner portions of the bag mouth of a handled bag formed of a thermoplastic film as described herein (comprising a high density polyethylene or, e.g., a film comprising a major amount of a high density polyethylene and a minor amount of a linear low density polyethylene, as hereinbefore described) decreases the tendency of the thermoplastic film to tear when the handled bag is used and stress from a load placed in the bag results in load and/or lifting stress at the corner portions.

EXAMPLE 2

Samples of Bag A and Bag B (bag according to the instant invention having smooth corner portions), as described in Example 1, were evaluated by applying the same sideway stress on the two opposing bag handles. Bag A and Bag B were evaluated according to the same test procedure for both Bag A and Bag B by clamping the opposing handles in opposing jaws of an Instron test device and measuring the maximum amount of force (load) required over a fixed distance to initiate tearing, as evidenced by tearing of the film at the corner portion. Four samples of Bag A and Bag B were evaluated with each bag containing a twenty (20) pound load. The results of the test to determine the maximum load were as follows:

| Test Bag No. | Bag A Load* (lbs) | Bag B (Smoother Corner Portions) Load* (lbs) |
|---|---|---|
| 1 | 2.8 | 5.75 |
| 2 | 2.65 | 7.45 |
| 3 | 2.50 | 5.55 |
| 4 | 2.70 | 9.98 |
| Average Value | 2.66 | 7.18 |

*Maximum or peak load during tearing.

The above results demonstrate that a significantly greater load was required to initiate tearing at the corner portion for Bag B (a handled bag according to the instant invention) as compared to Bag A (prior art). Accordingly, the corner portions are less prone to tear than the corner portions of Bag A and Bag B will have improved resistance to handle failure.

EXAMPLE 3

The improvement in end use performance of Bag B over Bag A of Example 1 and Example 2, was further evaluated according to the following procedure. A bag lift testing device was employed to determine the force required to pull the handles of the handled bag sufficiently apart such that the handles break by tearing from the bag. One handle is fastened to a fixed clamp and the other handle is fastened to a J-shaped claim on a roller attached to a load cell which records the maximum force exerted during the test until a handle is torn at the corner portion from the handled bag. The force is applied along a straight line of force by clamping each handle near the top. Five samples of Bag A and five samples of Bag B were tested in random order and the following results obtained:

| Test Bag No. | Bag A Force (lbs) | Bag B (Smoother Corner Portions) Force (lbs) |
|---|---|---|
| 1 | 6.7 | 10.6 |
| 2 | 6.2 | 13.1 |
| 3 | 6.0 | 11.4 |
| 4 | 5.7 | 11.9 |
| 5 | 5.4 | 13.1 |
| Average Value | 6.0 | 12.02 |

The above results demonstrate the significant increase in the amount of force required to pull the handles apart until a handle is torn at the corner portion as between Bag A and Bag B (according to the instant invention) wherein the sole difference between Bag A and Bag B is the introduction of smooth corner portions in Bag B. The above results are better appreciated by carrying out the above test with five sample control bags (Control Bag C) wherein Control Bag C is identical to Bag A except the high density polyethylene component described in Example 1 was replaced with an equal amount of the linear low density polyethylene bag set forth in Example 1. Evaluation of five samples of Control Bag C gave the following results:

| Test Bag No. | Control Bag C Force (lbs) |
|---|---|
| 1 | 11.2 |
| 2 | 12.7 |
| 3 | 12.3 |
| 4 | 12.2 |
| 5 | 11.4 |
| Average Value | 11.96 |

As can be seen from a comparison of Control Bag C, Bag A and Bag B, the problems of handle failure observed for Bag A did not manifest itself for a bag structurally the same but comprising a linear low density polyethylene film. Bag B, according to the instant invention, achieves end use performance (as to handle performance) similar to that achieved for Control Bag C while being formed from a thermoplastic film containing over 70 weight percent high density polyethylene. Such improvement and even a recognition of the problem have not heretofore been known in the prior art.

I claim:

1. A method for manufacturing a handled bag made of a thermoplastic film comprising a major amount of a high density polyethylene having a density greater than about 0.940 and a minor amount of a low density polyethylene having a density below about 0.930 wherein said handled bag comprises a front and rear bag wall, a closed bottom and an open mouth top portion having a pair of laterally spaced handles, said front and rear bag walls, between said handles defining an open bag mouth, an upper mouth edge formed from each handle extending above the mouth edge from a corner portion at a lower handle portion defining the lateral extent of said bag mouth to an upper handle portion defining a hand grip, a lower mouth edge extending intermediate the lower handle portions and meeting therewith at corner portions of said open top mouth portion wherein said handled bag is made by the following steps:

(1) forming a flattened tube of thermoplastic film;
(2) providing said flattened tube of thermoplastic film to a bag manufacturing station;
(3) clamping a portion of the flattened tube with a clamp having an opening for mating with a U-shaped punch-out knife, said portion to be the top portion of the handled bag;
(4) sealing transverse the flattened tube below the top portion to form a bottom portion of the handled bag and provide a seal across the top of said top portion of the next handled bag; and
(5) forming the open mouth top portion by use of a punch-out knife characterized as having a smoother cut-out edge in the area on the punch-out knife whereat the corner portion will be formed than at the lower mouth edge whereby a smoother cut-out edge will be formed at said corner portions than provided at said lower mouth edge whereby the smother cut-out edge of the corner portion reduces the tendency of the thermoplastic film to tear at the corner portion when subjected to stress.

2. A method according to claim 1 wherein the thermoplastic film comprises a blend of between about 65 and about 90 weight percent of a high density polyethylene having a density greater than 0.940 and between about 5 and about 30 weight percent of a linear low density polyethylene having a density of 0.910 and about 0.930.

3. A method according to claim 2 wherein the high density polyethylene has a high load melt index of between about 1.0 and about 15.0 and wherein the melt index of said linear low density polyethylene is between about 0.2 and about 5.0.

4. A method according to claim 3 wherein the high density polyethylene has a high load melt index of between about 5.0 and about 10.0 and wherein the melt index of said linear low density polyethylene is between about 0.5 and about 2.0.

5. A method according to claim 2 wherein the thermoplastic film comprises a blend of between about 65 and about 90 weight percent of a high density polyethylene having a density between about 0.945 and about 0.955 and between about 5 and about 30 weight percent of a linear low density polyethylene having a density of 0.910 and about 0.920.

6. A method according to claim 5 wherein the high density polyethylene has a high load melt index of between about 7.5 and about 9.0 and wherein the melt index of said linear low density polyethylene is between about 0.5 and about 2.0.

7. A method according to claim 1 wherein the thermoplastic film comprises at least 90 weight percent high density polyethylene having a high load melt index of between about 1.0 and about 15.0 and wherein the density is between about 0.945 and about 0.955.

8. A method according to claim 1 wherein the thermoplastic film has a thickness of between about 0.3 mils and about 3.0 mils.

9. A method according to claim 8 wherein the thermoplastic film has a thickness of between about 0.5 mils and about 1.5 mils.

10. A method according to claim 1 wherein said thermoplastic film has a thickness of between about 0.5 mils and about 1.5 mils and comprises between about 65 and about 90 weight percent of a high density polyethylene having a density of between about 0.945 and about 0.955 and a high load melt index between about 5.0 and about 10.0 and between about 0.5 and about 30 weight percent of a linear low density polyethylene having a density of about 0.910 and about 0.920, having a melt index between about 0.5 and about 2.0.

11. The method of claim 1 wherein said flattened tube of thermoplastic film of step (1) is provided with gussets.

12. The method of claim 1 wherein the handled bags are manufactured at a rate of at least 45 bags per minute.

13. The method of claim 12 wherein the handled bags are manufactured at a rate of at least 60 bags per minute.

* * * * *